United States Patent [19]

Umeda

[11] Patent Number: 4,555,000

[45] Date of Patent: Nov. 26, 1985

[54] APPARATUS FOR OPERATING AN ELEVATOR

[75] Inventor: Yasukazu Umeda, Kasugai, Japan

[73] Assignee: Mitsubishi Denki Kabushiki Kaisha, Tokyo, Japan

[21] Appl. No.: 616,803

[22] Filed: Jun. 4, 1984

[30] Foreign Application Priority Data

Jun. 7, 1983 [JP] Japan ..... 58-101300

[51] Int. Cl.[4] ..... B66B 1/18

[52] U.S. Cl. ..... 187/29 R

[58] Field of Search ..... 187/29; 340/19–21

[56] References Cited

U.S. PATENT DOCUMENTS

| | | | |
|---|---|---|---|
| 3,374,864 | 3/1968 | Port | 187/29 R |
| 4,042,067 | 8/1977 | Mandel | 187/29 R |
| 4,230,206 | 10/1980 | Brooks | 187/29 R |
| 4,376,930 | 3/1983 | Sasao | 340/20 X |

FOREIGN PATENT DOCUMENTS

| | | |
|---|---|---|
| 51-45853 | 4/1976 | Japan . |
| 55847 | 5/1978 | Japan . |
| 24310 | 5/1982 | Japan . |
| 432593 | 3/1935 | United Kingdom . |
| 456191 | 11/1936 | United Kingdom . |
| 1059283 | 2/1967 | United Kingdom . |
| 1358903 | 7/1974 | United Kingdom . |

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

The present invention relates to an apparatus for operating an elevator for an assignment of a plurality of cage calls for serving a plurality of floors on the basis of the cage calls under a group supervision which has a plurality of destination buttons provided in the halls of a plurality of floors, to be operated for registering the calls in the halls and the calls for the destination from the hall; assignment means receiving a signal generated by the operation of said destination button for assigning the call in the hall and the call for the destination for any one of said plurality of cages; and registering means for registering the call of the destination floor as a cage call and differentiating the registering time of the cage call according to the running state of the plurality of cages.

5 Claims, 3 Drawing Figures

APPARATUS FOR OPERATING AN ELEVATOR

BACKGROUND OF THE INVENTION

The present invention relates to an improved apparatus for controlling an elevator.

An up button and a down button are normally installed in an elevator hall. A passenger who desires to go up presses the up button and a passenger who desires to go down presses the down button thereby calling a cage so that the passenger can ride in the cage. The passenger then registers a car call by activating a destination button means in the cage which causes the cage to move to desired floor.

On the other hand, an elevator system in which destination buttons are provided in each of the halls of a building having a plurality of floors to register in advance a desired destination floor, to avoid the necessity of operation of the destination button thereafter in the cage has been recently proposed, for example, in a Japanese Patent Publication No. 24,310/1982. The advantages of such an elevator system are largely classified into the following two points:

(a) Only one operation is sufficient for a user who utilizes the elevator.

(b) Since the destination of a passenger who wishes to ride in a cage can be identified before the cage arrives at the floor at which the passenger is waiting, the performance of a group supervision apparatus is improved to shorten the waiting time of passengers and to reduce the instances in which elevators pass a floor due to a full passenger load.

However, there arises a problem when utilizing the advantages of elevator system of this type. Namely, when the destination floor which is registered in the hall is registered as a cage call for stopping the cage, if the call is registered for a given destination floor by a passenger who is uncertain of the floor number he wants the car to stop at, the stopping of the cage becomes wasteful. If the cage calling is, on the other hand, delayed, the information of the cage calling is not inputted when the hall call is assigned. Therefore, the above-described advantage described in the above paragraph (a) for improving the performance of the group supervision apparatus cannot be achieved in any case. Further, if the cage call is extremely delayed, the cage call is not yet registered when the passager has entered in the cage. Consequently, the passenger has to press the destination button in the cage, thereby eventually obviating the advantage described in the above paragraph (a). (For this reason, the destination buttons are normally also provided in the cage for the passenger who does not press the destination button in the elevator hall.)

SUMMARY OF THE INVENTION

The present invention has been made to eliminate the above-described drawbacks and has for its object to provide an apparatus for operating an elevator in which the time of registering a cage call due to the operation of a destination button in an elevator hall is differentiated according to the state of a cage, thereby allowing a passenger to operate the elevator system without anxiety and improving the performance of a group supervision apparatus.

BRIEF DESCRIPTION OF THE DRAWINGS

FIG. 4 is a fragmentary portion of a logical circuit illustrating an alternative embodiment.

DESCRIPTION OF THE PREFERRED EMBODIMENT

Figure 1:
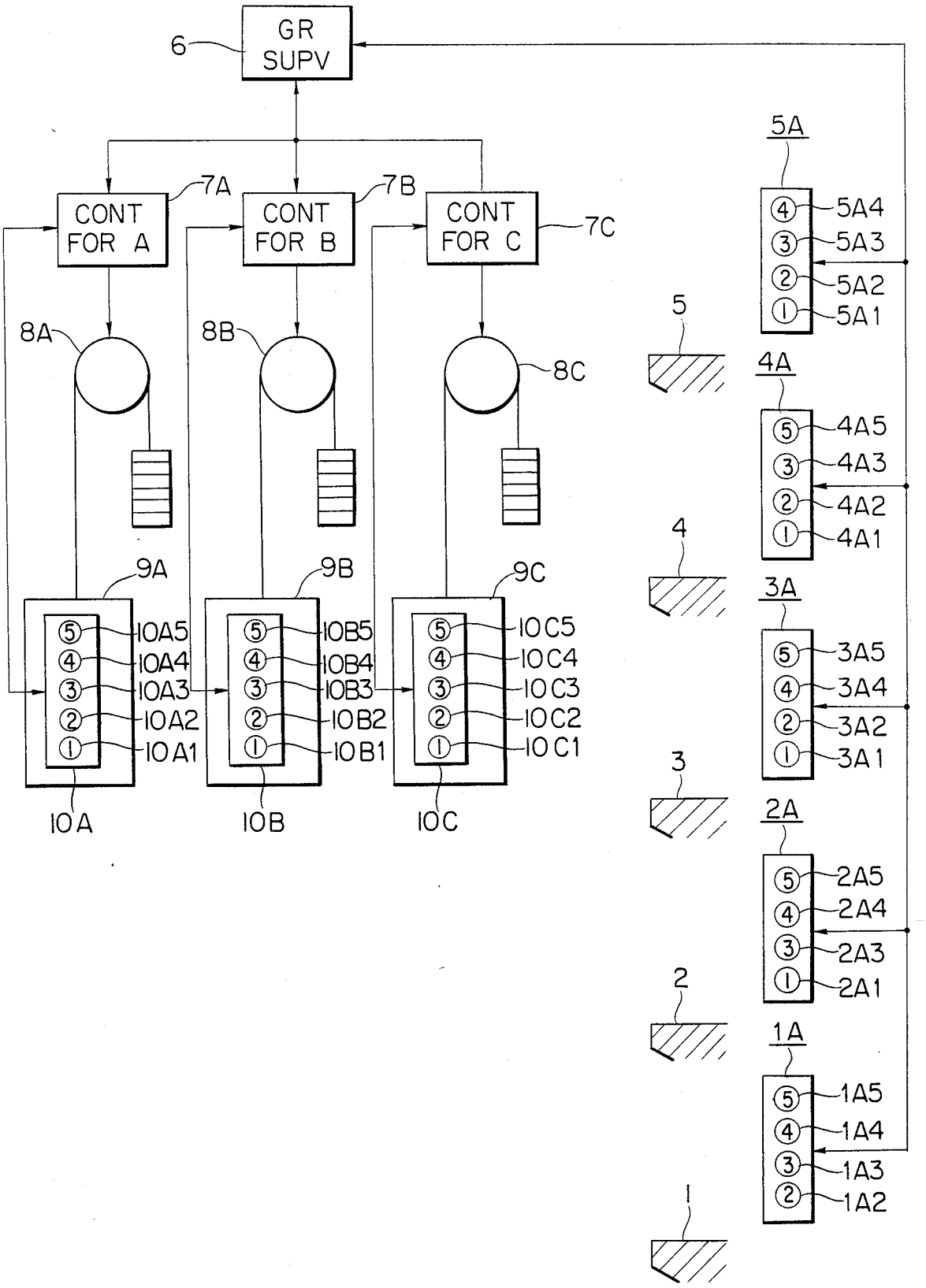
FIG. 1 is a diagram showing the construction of an apparatus for operating an elevator according to an embodiment of the present invention.
Figure 2:
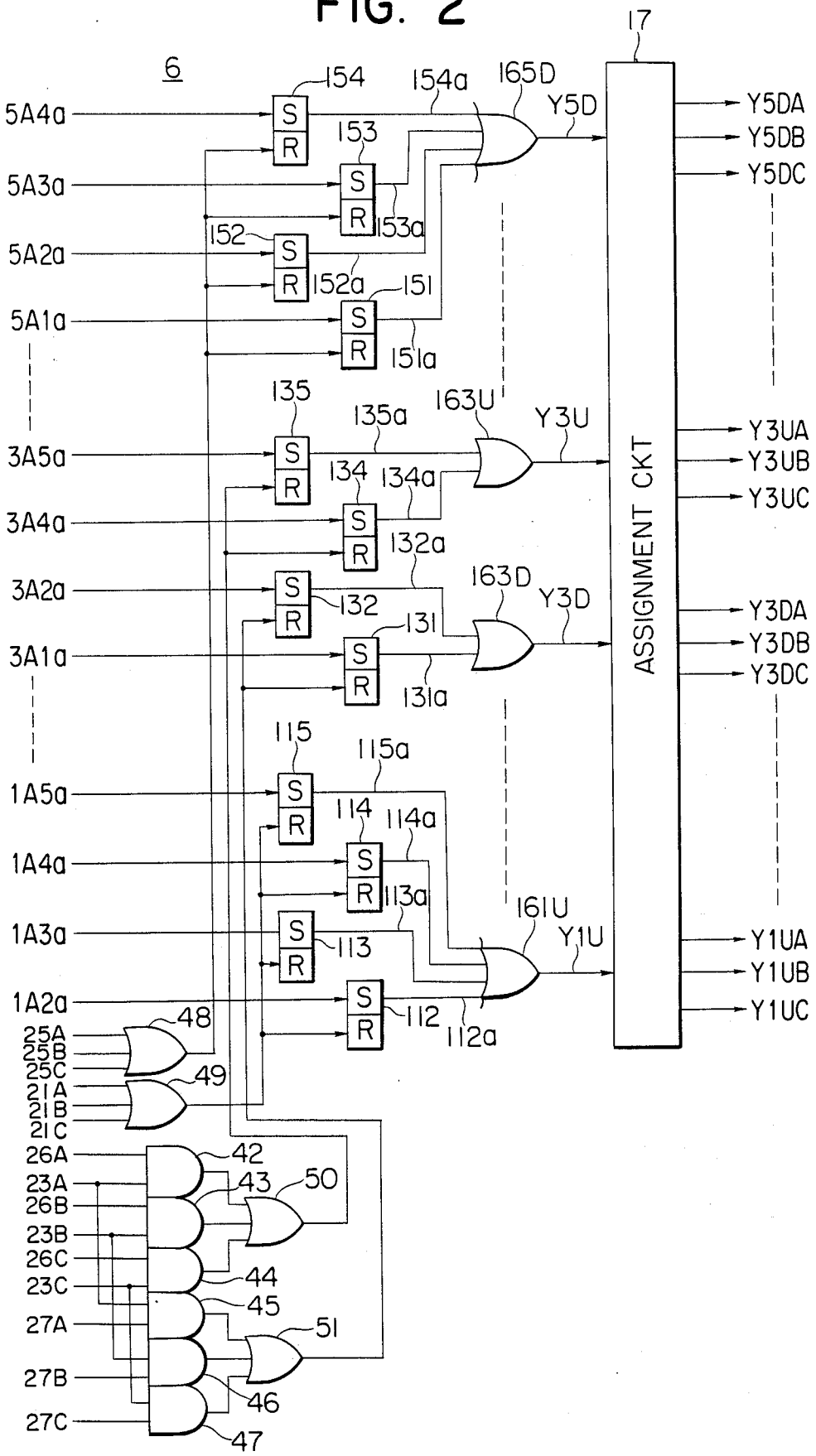
FIG. 2 is a circuit diagram of a logical circuit of a group supervisor in FIG. 1.

An embodiment of the invention will be described below in conjunction with FIGS. 1 to 3.

In the drawings, reference numerals 1 to 5 respectively denote first to fifth floors, numerals 1A to 5A respectively denote hall operation boards installed in the halls of the first floor 1 to fifth floor 5, numerals 1A2 to 1A5 denote second to fifth floor destination buttons provided on the operation board 1A in the hall of the first floor, and numerals 2A1, 2A3, to 2A5, 3A1, 3A2, 3A4, 3A5, 4A1 to 4A3, 4A5, 5A1 to 5A4 respectively denote destination buttons for the operation boards 2A to 5A in the halls of the second to fifth floors (destination buttons for corresponding floors such as, for example, a second floor destination button for designating the second floor is not provided in the hall operation board 2A), and which respectively generate destination button signals 1A2*a* to 1A5*a*, . . . 3A1*a*, 3A2*a*, 3A4*a*, 3A5*a* . . . 5A1*a* to 5A4*a* (in FIG. 2) which become "H" when the destination buttons 1A2 to 1A5 for designating the second floor to the fifth floor by the operation board 1A in the hall of the first floor . . . the destination buttons 3A1, 3A2, 3A4, 3A5 for designating the first, second, fourth and fifth floors by the operation board 3A in the hall of the third floor . . . the destination buttons 5A1 to 5A4 for designating the first to fourth floors by the operation board 5A in the hall of the fifth floor are depressed. Reference numeral 6 denotes a known group supervisor, numerals 7A to 7C denote controllers for controlling cages 9A to 9C of elevator Nos. A to C, numeral 8A to 8C respectively denote winches of the cages 9A to 9C of the elevator Nos. A to C, numerals 10A to 10C respectively denote operation boards installed in the cages 9A to 9C, numerals 10A1 to 10A5, 10B1 to 10B5, 10C1 to 10C5 respectively denote cage buttons for registering cage calls by the respective first to fifth buttons provided on the operation boards 10A to 10C in the cages. Activation of a cage button causes a high signal "H" to be generated for that cage button, thereby registering the cage call in the respective controller 7A to 7C. For example, a cage button signal 10A5*a* becomes "H" upon activation of the destination button 10A5 for the fifth floor of the elevator No. A as shown in FIG. 3. In FIG. 2, reference numerals 112 to 115 . . . 131, 132, 134, 135 . . . 151 to 154 respectively denote RS flip-flops (which are hereinafter referred to as "memories") which generate as outputs 112*a* to 115*a* . . . 131*a*, 132*a*, 134*a*, 135*a* . . . 151*a* to 154*a* calling register signals for the respective memories 112 to 115 . . . 131, 132, 134, 135 . . . 151 to 154, numerals 161U . . . 163D, 163U . . . 165D respectively denote OR gates, Y1U . . . Y3D, YsU . . . Y5D respectively denote the outputs of the OR gates 161U . . . 163D, 163U . . . 165D, and represent a first floor up calling register signal . . . third floor down calling register signal, third floor up calling register signal . . . fifth floor down calling register signal, respectively. Reference numeral 17 denotes an assignment circuit for assigning calls for any of the cages 9A to 9C when the calls are generated, which is known as shown in FIG. 4 of Japanese Patent Application Laid-open No. 55,847/1978. Reference numerals Y1UA to Y1UC . . . Y3DA to Y3DC, Y3UA to Y3UC . . . Y5DA to Y5DC respectively denote assignment signals which become "H" when the first up calling signal Y1U . . . third floor down calling signal Y3D, third floor up calling signal Y3U . . . fifth floor down calling signal Y5D are assigned for the cages 9A to 9C, respectively, numerals 21A to 21C respectively denote first floor cage position signal which become "H" when the cages 9A to 9C have arrived at the first floor 1, respectively, numeral 23A to 23C . . . 25A to 25C respectively denote similarly third floor . . . fifth floor cage position signals, numerals 26A to 26C respectively denote up direction signals which become "H" when the cages 9A to 9C move upwards, and numerals 27A to 27C respectively denote down direction signals which become "H" when the cage 9A to 9C move downwards. In FIG. 3, reference numerals 28 to 31 respectively denote AND gates, numerals 32 to 35 respectively denote OR gates, numerals 36 to 39 respectively denote AND gates, numeral 40 denotes an OR gate, numeral 41 denotes a memory similar to the above-described flip-flops, and numeral 41*a* denotes the output of the memory 41, the fifth floor cage calling register signal of the cage 9A. In FIG. 2, reference numerals 42 to 47 denote AND gates, and numerals 48 to 51 denote OR gates, respectively.

The operation of this embodiment of the invention will be described hereinbelow.

Initially, it is assumed that the fifth floor destination button 3A5 of the operation board 3A in the hall of the third floor 3 is now depressed, i.e., a passenger who desires to go from the third floor 3 to the fifth floor 5 activates the button 3A5.

Since the fifth floor destination button signal 3A5*a* of the third floor thus becomes "H", the memory 135 is set as long as the output of the OR gate 50 is "L", i.e., as long as the cage travelling in the up direction does not arrive at the third floor. Accordingly, the fifth floor calling register signal 135*a* of the third floor on the output of the memory 135 becomes "H". Thus, the call is registered, and a call register lamp (not shown) contained in the destination button (3A5) is energized. Further, since the third floor up calling register signal Y3U on the output of the OR gate 163U becomes "H", the assignment circuit 17 allocates a cage to service the call. Assuming that this call is allocated to the car of the elevator No. A, the third floor up calling assignment signal Y3UA of the elevator No. A becomes "H". Thus, the memory 41 is set through the OR gate 34, the AND gate 38 and the OR gate 40, the fifth floor cage calling register signal 41*a* becomes "H", with the result that a call register lamp (not shown) contained in the cage button 10A5 is energized. In other words, when a fifth floor destination call is registered on the third floor 3, the cage call of the fifth floor of a cage to be assigned is substantially simultaneously registered. The controller 7A for the elevator No. A allows the winch 8A to run the cage 9A and to stop the cage 9A at the third floor 3 (omitted in the circuit). When the cage 9A arrives at the third floor 3 and is assigned in the up direction, both the cage position signal 23A and the up direction signal 26A are "H". Accordingly, the output of the OR gate 50 becomes "H" due to the output of the AND gate 42, the memory 135 is reset, the fifth floor calling register signal 135*a* of the third floor becomes "L", and the above-described call register lamp of the fifth floor destination button 3A5 of the third floor is deenergized.

Since the cage calling of the fifth floor is already registered, the cage 9A starts at the third floor 3 and runs to the fifth floor 5, and when the cage 9A has arrived at the fifth floor 5, the cage position signal 25A becomes "H". Thus, the memory 41 is reset, the cage calling register signal 41*a* of the fifth floor becomes "L", and the above-described calling register lamp of the cage button 10A5 of the fifth floor is deenergized.

Assuming that the call for the fifth floor destination is assigned to the cage 9B when the fifth floor destination button 3A5 of the third floor is depressed, since the third up calling assignment signal Y3UA is "L", the fifth floor cage calling register signal 41*a* of the cage 9A does not become "H", with the result that the cage call is not registered. However, in case that the cage 9A is moving in the up direction and has arrived at the third floor 3 earlier than the cage 9B (due to a call at the third floor or the like), both the cage position signal 23A and the up direction signal 26A become "H" when the cage 9A has arrived at the third floor 3. Thus, the output of the AND gate 30 becomes "H". In this manner, the memory 41 is set through the OR gate 34, the AND gate 38 and the OR gate 40, the fifth floor cage calling register signal 41*a* of the cage 9A becomes "H", with the result that the cage call of the fifth floor is registered. At this time, the assignment of the cage 9B to the fifth floor due to the destination button 3A5 may be arranged to be cancelled.

It should be noted that, since the fifth floor calling register signal 135*a* of the third floor becomes "L" as soon as the cage arrives at the fifth floor, it is necessary to provide a time delay, for example, with the time delay circuits TD (FIG. 3), so that the signal 135*a* which is inputted to the AND gate 38 becomes "L" at a slight delay in an actual case.

When a passenger has entered the cage 9A without depression of the destination buttons 3A1, 3A2, 3A4, 3A5 and desires to register a cage call to the fifth floor, the cage button signal 10A5*a* becomes "H" when the passenger presses the cage button 10A5 of the fifth floor, the output of the OR gate 40 becomes "H", the memory 41 is set, and the cage calling register signal 41A becomes "H".

As described above, the cage call is immediately registered for the cage which is assigned to the call, thereby considering the cage call in the later assignment, and the assignment thus becomes more accurate.

Figure 3:
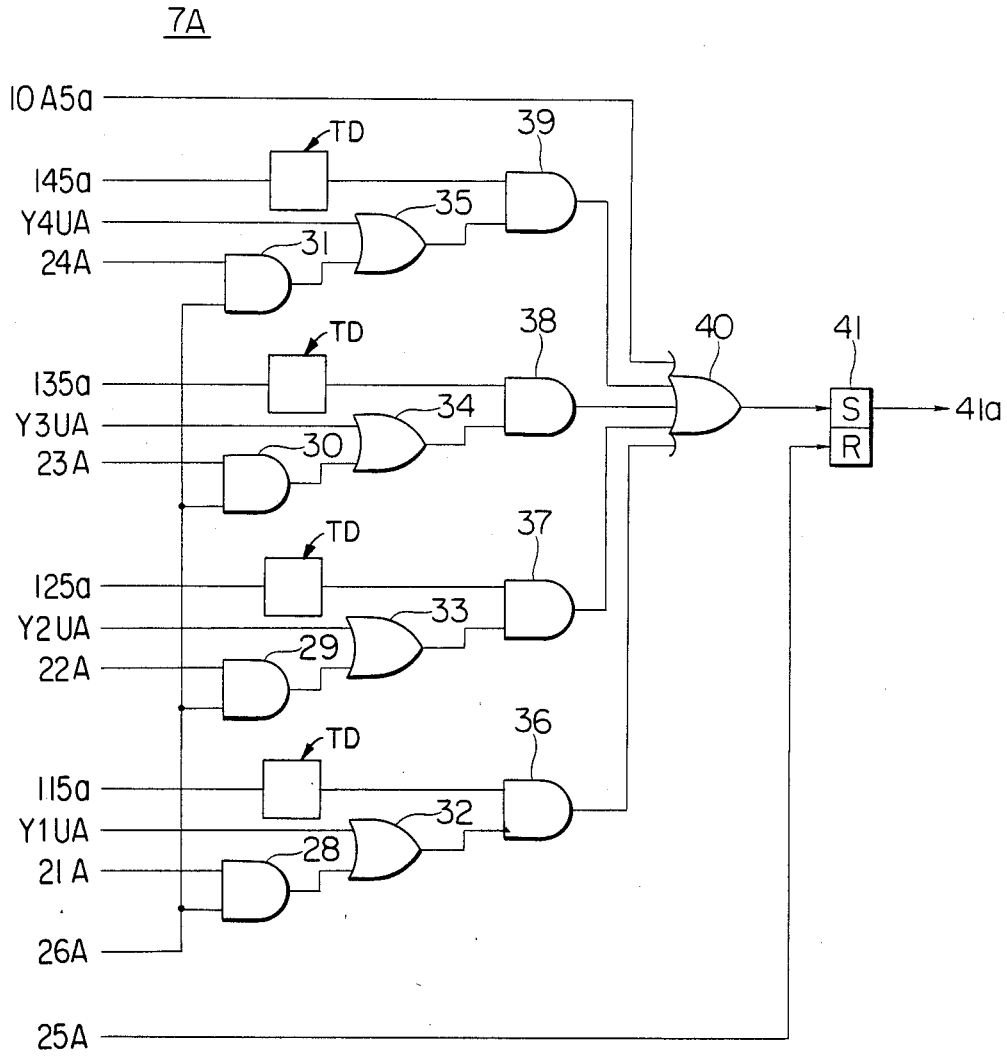
FIG. 3 is a logical circuit showing part of a controller for an elevator No. A in FIG. 1.

In the embodiment described above, the circuits for the second floor 2 and the fourth floor 4 were omitted for the convenience of simplicity, and only the fifth floor cage calling register circuit of the cage 9A is shown in FIG. 3. However, the omitted circuits may be similarly constructed in the same manner.

In the embodiment described above, the cage calling register time was determined at the assigning point in time when the cage was assigned, and at the cage arriving point in time when the cage was not assigned. Thus, the time of registering the cage calling by the hall button is differentiated according to the running state of the cages. The present invention is not limited to the particular embodiment previously discussed. In summary, the cage calling may be registered at the point in time when the fact has become substantially certain that the number of passengers which have risen in the cage is substantially the same number as the passengers who registered for the destination floor in the hall.

In the embodiment described above, three cages 9A to 9C have been controlled under group supervision. However, the present invention is not limited to the particular number of cages.

According to the present invention as described above, the time of registering the cage calling which is registered in the hall for the destination floor is differentiated according to the running states of the cages. Therefore, a passenger can operate the button for the destination floor with less anxiety, thereby improving the performance of the group supervision to shorten the waiting time and to reduce the passage of the cage due to full passengers in the cage.

What is claimed is:

1. An apparatus for operating a plurality of elevators for serving a plurality of floors on the basis of cage calls under group supervision comprising:

(a) a plurality of destination buttons provided in the hall of each of a plurality of floors to be operated for registering the calls in the hall and the calls for the destination from the hall;

(b) assignment means receiving signals generated by the operation of said destination buttons for assigning the calls in the hall for any one of said plurality of cages;

(c) a plurality of destination buttons provided in each of said plurality of elevators to be operated for registering destination floors for the respective cage; and (d) registering means for registering the calls of said destination floors from both the hall buttons and the cage buttons as cage calls, the cage calls from the cage buttons being registered immediately and the cage calls from the hall buttons being registered at different registering times according to the running state of said plurality of cages.

2. An apparatus for operating a plurality of elevators as set forth in claim 1 wherein:

said registering means registers a cage call for a cage at the assigning point in time when the cage is assigned and at the arriving point in time at a floor when the cage is not assigned.

3. An apparatus for operating a plurality of elevators as set forth in claim 2 wherein said registering means cancels a registered cage call from an assigned cage when a cage not assigned to the cage call arrives before the assigned cage at the floor at which a hall button has been operated.

4. An apparatus for operating a plurality of elevators as set forth in claim 2 including a gating circuit to control the feeding to said assignment means of signals generated by the hall buttons.

5. An apparatus for operating a plurality of elevators for serving a plurality of floors on the basis of calls under group supervision comprising:

(a) a plurality of destination buttons provided in the hall of each of a plurality of floors to be operated for registering the calls in the hall and the calls for the destination from the hall;

(b) assignment means receiving signals generated by the operation of said destination buttons for assigning the calls in the hall for any one of said plurality of cages; and (c) registering means for registering the calls of said destination floors as cage calls and registering a cage call for a cage at assigning point in time when the cage is assigned and at arriving point in time at a floor when the cage is not assigned.

* * * * *